US006749196B2

(12) United States Patent
Serlachius

(10) Patent No.: US 6,749,196 B2
(45) Date of Patent: Jun. 15, 2004

(54) ICE HOCKEY GAME

(75) Inventor: Fredrik Serlachius, Grankulla (FI)

(73) Assignee: Bullit, Inc., Esbo (FI)

( * ) Notice: Subject to any disclaimer, the term of this patent is extended or adjusted under 35 U.S.C. 154(b) by 0 days.

(21) Appl. No.: 10/052,693

(22) Filed: Jan. 18, 2002

(65) Prior Publication Data

US 2002/0109292 A1 Aug. 15, 2002

(30) Foreign Application Priority Data

Jan. 18, 2001 (FI) ..... 20010032 U
Jan. 14, 2002 (FI) ..... 200220066

(51) Int. Cl.[7] ..... A63F 7/06; A63F 3/00

(52) U.S. Cl. ..... 273/108.51; 273/126 R; 273/282.1

(58) Field of Search ..... 273/108.1, 108.56, 273/108.55, 108.51, 119 R, 126 R, 282.1, 441, 153 S, 264, 258; D21/339, 340, 341

(56) References Cited

U.S. PATENT DOCUMENTS 567,885 A * 9/1896 Conklin
1,682,329 A * 8/1928 Glavin
2,398,726 A * 4/1946 Seguin
3,130,972 A * 4/1964 Schwarlander ..... 273/258
3,638,948 A * 2/1972 Smith ..... 273/275
3,741,541 A 6/1973 Crismani
3,811,674 A 5/1974 Trbovich et al.
3,912,269 A 10/1975 Barlow
4,009,881 A 3/1977 Potter, III
4,014,543 A 3/1977 Arad
4,018,443 A 4/1977 Bird
4,025,073 A 5/1977 Furr et al.
4,470,601 A * 9/1984 Finn ..... 273/153 S
4,474,375 A 10/1984 Stockdale
4,647,049 A * 3/1987 Oretsky et al. ..... 273/264
4,886,278 A * 12/1989 Salter et al. ..... 273/242
5,046,734 A 9/1991 Laine
5,222,735 A 6/1993 Savage
5,233,798 A * 8/1993 Shaw et al. ..... 52/64
5,427,379 A * 6/1995 Lee ..... 273/281
5,433,443 A 7/1995 Ples
5,437,459 A * 8/1995 Kirby ..... 273/246
5,497,997 A * 3/1996 Nikas et al. ..... 273/264
5,655,767 A 8/1997 Francis et al.
5,868,390 A * 2/1999 Ripley

FOREIGN PATENT DOCUMENTS

EP 0 947 227 A1 10/1999
FI 881412 8/1993
SE 8903221-3 7/1991

* cited by examiner

*Primary Examiner*—Sebastiano Passaniti
(74) *Attorney, Agent, or Firm*—Merchant & Gould P.C.

(57) ABSTRACT

An ice hockey board game where the player pegs (6) can move all around the game level through the network of miniature levels (3). The player pegs (6) are moved around by hand along the gaps (4). The shots are accomplished by rolling the player peg (6) through the fingers. The ice hockey game thus comprises a support level (9) and, on top of the support level (9), a game level (2, 3) which consists of separate miniature levels (3), larger in diameter than the studs (5) which studs (5) fasten it to the support level (9), and, for free movement of the player pegs (6), gaps (4) are made between them where the player pegs (6) stay with the help of the wider bottom part (7).

10 Claims, 2 Drawing Sheets

ICE HOCKEY GAME

TECHNICAL FIELD OF THE INVENTION

The invention relates to a game mainly intended for an ice hockey game, but the concept can be applied to a soccer game.

BACKGROUND OF THE INVENTION

Since time immemorial, there have been diverse games for people of all ages. There are games which exist for a short time, thereafter disappearing for good and there are games which, already at birth, become legendary. An example of the latter type is the so-called STIGA Table Hockey Game. It was created at the beginning of the 60s and continues to be one of the most popular party games. Once in a while, an ice hockey or soccer game is launched into the market in the form of a dice game. However, the nature of the real games is so rough and fast that their implementation in the form of a dice game has not proved to be a successful solution. But, the era of computers has presented new opportunities for the implementation of such games. In the form of computer games, these fast-speed team games are very popular indeed.

A negative feature of the above-mentioned dice ice hockey game is that it is slow due to the fact that the players take their turn to roll the dice, based on which they move their player peg. Hence, the players cannot act simultaneously, which seems to be quite contrary to the spirit of ice hockey.

In contrast, the Swedish STIGA game largely includes all the elements missing from a dice game. The STIGA game consists of a solid rink, with the surrounding sideboards, just as in real life. The game board has longitudinal gaps, opened or sawn into it, in which the player pegs move. The player pegs are moved around with long rods protruding from the short sideboards. By pushing the rod forward, the player peg moves forward and vice versa. The rod can also be moved around like a screw with fingers, creating a rotating motion of the player peg, simulating a slapshot. A shot can also be accomplished by pushing the rod sharply forward, whereupon the puck shoots away from the player peg. Hence, each player peg is attached to the end of the respective rod, which also holds each player peg to its own track. So the rods move below the game board, under it, steering the player pegs moving on the board, this is, on the top of the board. The game is fast, at times even rough, simulating the events of a real ice hockey game quite well. With the help of the rods, the players, this is, the two of them, try to score as many goals into the opponent's goal as possible. The opponent's goalie, moved with a shorter rod or a shaft, guards the goal. The player having scored the most goals within a certain time period is the winner.

The Stiga game also has its weaknesses. First of all, the player pegs'range of movement is restricted. Each player peg can only move along its own longitudinal track. In other words, the player pegs never meet in the rink. This can make the game events clearer but poorly correspond to playing real ice hockey. Another negative feature has to do with the movability of the player pegs. Turning the rods is painful especially for a smaller person. The activity requires so much finger power that the STIGA game is not suitable for smaller children, which is a pity, as it is just those younger children who have so much enthusiasm. Consequently, STIGA has become a popular game among those little older in age.

BRIEF SUMMARY OF THE INVENTION

Hence, the purpose of the invention in question is to create an ice hockey game of a new art also suited for the youngest ones. The solution is reached with a game according to the invention, comprising a rink consisting of a support level and a game level on top of the support level. The game level consists of separate miniature levels whose diameter is larger than that of the studs with which the miniature levels are attached to the support level. For unobstructed movement, gaps have been formed between the miniature levels in which, because of the wider bottom part, the player pegs stay on the game board.

With a game of this art, desired results are achieved as, first of all, each player peg can reach every corner of the rink's game level through a network of miniature levels covering the entire game level. Second, the big-size, roundish player pegs are easy to move by hand along the gaps. A slapshot or a shot is accomplished by rolling the player peg between the fingers, which is easy thanks to the shape of the player pegs. And, it is easy to move the player pegs back and forth, due to the smooth, flat, button-like bottom part of the player pegs. It is easy to glide a player peg along the surface of the support level. The wide bottom part is followed by the thinnest part of the player peg, enabling removal from the gap. The thinnest part is directly followed by the second wide part of the player peg directly adjacent to the game level, and it has a smooth bottom surface for keeping it from sticking to the surface of the game level when being moved. In order for the player peg to stay in its track, or in the gap, its bottom part has to be wider than the gap. But, in order to create such a gap into which a player peg equipped with a button-type or a bottom part made wider with some other means could be pushed, an air space is required between the support level and the game level. As the game level cannot hover in the air, it has to be mounted onto the support level with supports or studs. And, because of creating a uniform network of gaps, the game level consists of several separate miniature levels which all must have their own support.

These supports or studs must have a diameter smaller than the miniature level being supported, in order to allow 360 degrees of free air space. The distance between the support and the outer edge of the miniature levels must be at least half of the diameter of the bottom part of the player peg in order to create preconditions for unobstructed movement of the player peg. A part similar to the blade of an ice hockey stick is attached to a player peg's part next to the game level's surface to be used to shoot the puck. The blade must be longer than half of the miniature level's diameter measured at its longest place in order for the puck never to land in a dead spot, or for the puck to be always in the game. Also for economic and technical reasons, the several miniature levels of the game level should be of the same size and form.

The best end result is attained with a network of honeycomb-patterned miniature levels as it eliminates sharp curves and long straights. These either abruptly slow down the course of the game or speed it up to the point where it becomes uninteresting. The honeycomb-patterned system allows the player pegs to swing naturally from side to side, a move simulating ice-skating. Wood is an excellent material for making the game board although plastic can be used, too. The entire above-mentioned two-level rink can also be cut out of a single thicker board using a technique which leaves a somewhat upside down T groove, which directly forms a track for the player pegs. This would save moulding costs as the supports under the miniature levels as well as the actual miniature levels would be made directly with a milling cutter. The same material used for the rink could well be used for the player pegs.

BRIEF DESCRIPTION OF THE DRAWINGS

Below, the invention is explained, with references to the appended drawings in which.

DETAILED DESCRIPTION OF THE INVENTION

Figure 1:
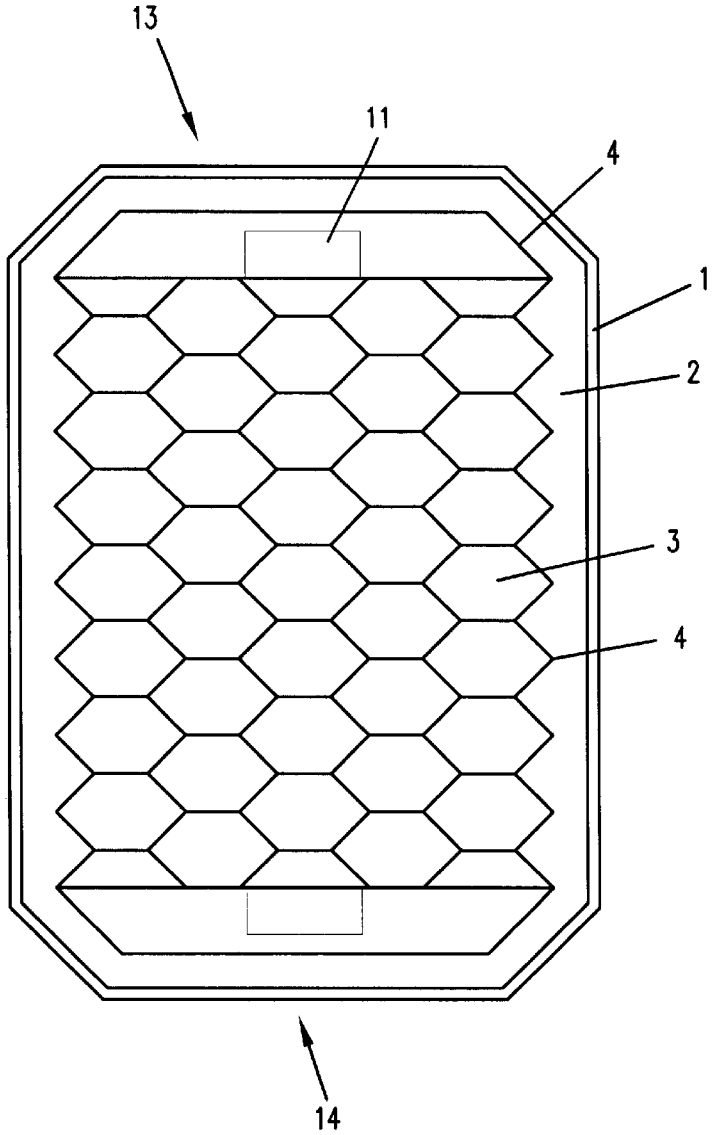
FIG. 1 shows the game level of the rink from above.

FIG. 1 shows the sideboard of the rink from above. It is approximately 0.3–0.5 cm thick and approximately 5–10 cm high. The side field 2 of the game level 2,3 is shown directly adjacent to the sideboard 1. FIG. 1 also shows the separate honeycomb-patterned miniature levels 3 of the game level 2,3. The gap 4, along which the player pegs 6 can be moved, is shown between the miniature levels 3. At the ends of the rink, the goals 11 are shown around which the gap, or track 4, circles. The rink has a first end 13 and a second end 14, FIG. 1.

Figure 2:
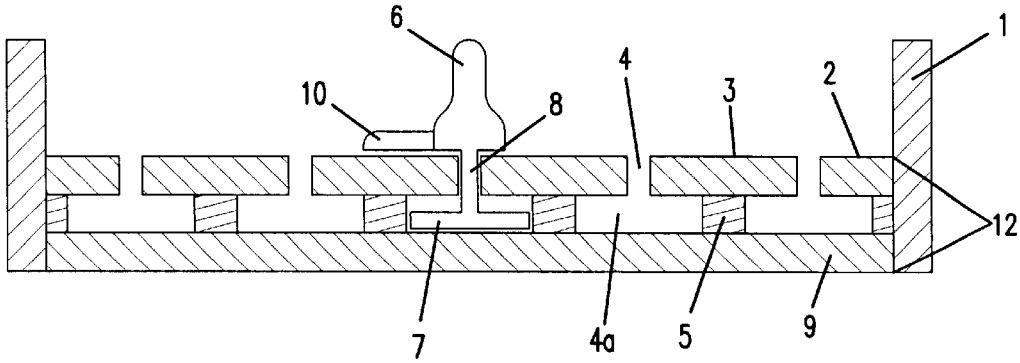
FIG. 2 shows a traverse section of the rink.

FIG. 2 shows a transverse section of the sideboard 1. The side field 2 of the game level 2,3 is shown next to the sideboard 1. FIG. 2 also presents a transverse section of the miniature levels 3 and the gaps 4 between the miniature levels 3. For the wide bottom part 7 of the player pegs 6, there is an air space 4*a* between the rink's support level 9 and the game level 2,3. FIG. 2 also shows a transverse section of the miniature levels' 3 studs 5 which are attached to the support level 9. FIG. 2 also shows the thin middle part 8 of the player peg 6, which fits to move in the gaps 4 between the miniature levels 3. The blade 10 of the player peg 6 is attached thereto. Together with the rink support level 9, the studs 5, and levels 3 comprise a gap net 12, FIG. 2.

Figure 3:
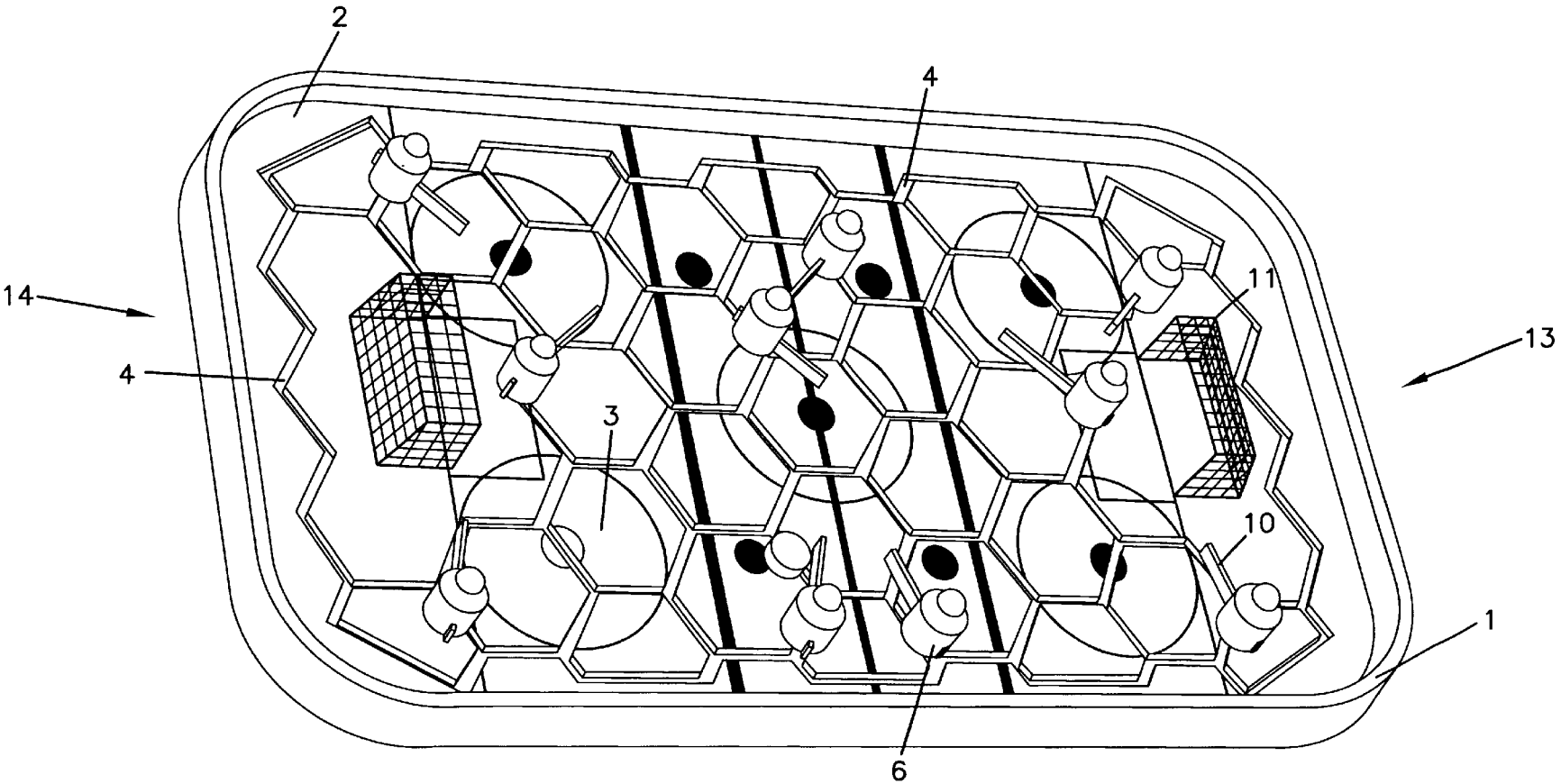
FIG. 3 shows a perspective view of the rink.

FIG. 3 shows a perspective view of the rink. The clarification, with the related drawings, is solely intended for illustrating the concept according to the invention. The details of the game according to the invention may vary within the framework of the claims.

What is claimed is:

1. A game comprising:

a) a gap net comprising:

i. a support level;

ii. studs mounted on said support level said studs separated by a gap;

iii. a game level having a first end and a second end, said game level comprising substantially uniform hexagonally shaped levels mounted on said studs, said levels defining a corresponding hexagonal pattern of gaps between said levels;

b.) player pegs comprising a bottom, a middle, and a top wherein when moving said player peg towards said first end or said second end, said player peg moves in a generally diagonal direction.

2. The game of claim 1, wherein when moving said player peg on said gap net, said player peg does not encounter a right angle.

3. The game of claim 1, wherein the gap between said levels is narrower than the gap between the studs.

4. The game of claim 1, wherein said player peg bottom is configured to hold said player peg in said gap net.

5. The game of claim 1, wherein said stud has a first diameter and said level has a second diameter, the difference between said first and second diameter being at least one-half of the diameter of said player peg bottom.

6. A game comprising:

a.) a gap net comprising:

i. a support level;

ii. studs mounted on said support level, said studs separated by a gap;

iii. a game level having a first end and a second end, said game level comprising levels configured in a honeycomb-patten, said levels defining a corresponding pattern of gaps; and b.) player pegs comprising a bottom, a middle, and a top wherein when moving said player peg towards said first end or second end, said player peg moves in a generally diagonal direction.

7. The game of claim 6, wherein when moving said player peg on said gap net, said player peg does not encounter a right angle.

8. The game of claim 6, wherein the gap between said levels is narrower than the gap between the studs.

9. The game of claim 6, wherein said player peg bottom is configured to hold said player peg in said gap net.

10. The game of claim 6, wherein said stud has a first diameter and said level has a second diameter, the difference between said first and second diameter being at least one-half of the diameter of said player peg bottom.

* * * * *